United States Patent [19]

Schaeffer

[11] Patent Number: 4,922,942

[45] Date of Patent: May 8, 1990

[54] TENT AND METHOD OF ERECTION

[76] Inventor: Stephen W. Schaeffer, 693 Old Falmouth Rd., P.O. Box 1030, Marstons Mills, Mass. 02648

[21] Appl. No.: 319,947

[22] Filed: Mar. 7, 1989

[51] Int. Cl.[5] ..... E04H 15/64

[52] U.S. Cl. ..... 135/90; 135/99; 135/905

[58] Field of Search ..... 135/90, 99, 100, 905, 135/106, 114, 119

[56] References Cited

U.S. PATENT DOCUMENTS

| | | | |
|---|---|---|---|
| 949,620 | 2/1910 | Chastant | 135/90 |
| 2,567,697 | 9/1951 | Craighead, Jr. et al. | 135/90 |
| 2,879,780 | 3/1959 | Arbore | 135/100 |
| 3,406,698 | 10/1968 | Hutchinson | 135/100 |
| 3,498,305 | 3/1970 | Hulin | 135/90 |
| 3,945,106 | 3/1976 | Mayr et al. | 135/905 |
| 4,284,095 | 8/1981 | Norton | 135/90 |

FOREIGN PATENT DOCUMENTS

| | | | |
|---|---|---|---|
| 16824 | of 1898 | United Kingdom | 135/90 |

*Primary Examiner*—David A. Scherbel
*Assistant Examiner*—Caroline D. Dennison
*Attorney, Agent, or Firm*—Richard P. Crowley

[57] ABSTRACT

A tent, tent kit and method of erecting a tent about a free-standing tree or post element and which tent comprises a truncated, conical tent shelter material having a top opening which fits around the free-standing element, a closure means to enclose the side edges of the canopy in use to form a teepee tent about the free-standing element, and an adjustable, flexible belt to be secured snugly at a predetermined height about the free-standing element, the belt containing a hoist pulley secured to the belt and a pulley line secured through the pulley and secured to the top edge of the tent shelter material so as to permit the user to hoist the canopy about the free-standing element to a desired height and ground stakes and lines to secure the lower edges of the tent material in a tent structural form.

12 Claims, 1 Drawing Sheet

TENT AND METHOD OF ERECTION

BACKGROUND OF THE INVENTION

Typically, tents have been provided with and use a separately supplied central tent pole which serves as a central support for both the erection of the tent and the maintenance of the tent once erected. There are numerous patents directed to tent structures and methods of erecting a tent, particularly a conical or teepee type tents.

For example, U.S. Pat. No. 3,406,698, issued Oct. 22, 1968 is directed to a conical configurated tent supported from a single, central pole and wherein the canopy has an opening at its apex to fit about the central pole and which tent has a removable cap that fits over the opening in the apex. The tent disclosed employs a plurality of coil springs and pulleys and ropes so that the conical canopy may be hoisted into position without a central pole, and thereafter a central flap placed on the opening.

Another patent directed to a conical-type is U.S. Pat. No. 3,875,952, issued Apr. 8, 1975 where the tent canopy has a reduced top extension wherein the tent canopy is connected to a rigid circular frame connected to tension-coiled springs with the other ends of the springs secured to pulleys in order to raise the tent into the desired tent structure and position.

A further patent, U.S. Pat. No. 4,133,341, issued Jan. 9, 1979, encloses a central dome-like tent structure with wires extending from a central support to hold the fabric in position.

It is desirable to provide a tent which is easily and quickly erected and without the need for a separate central pole and in particular, a tent kit which may easily be carried and from which a tent can be erected easily and quickly about a free-standing tree or post.

SUMMARY OF THE INVENTION

The present invention relates to a tent for erection about a free-standing element, such as a tree or post, and a compact, easily portable tent kit which excludes a central pole element, and a method of erecting a tent about a tree or free-standing post.

A tent has been discovered which is adapted to be erected about a free-standing post, particularly a delimbed tree, in a rapid and effective manner, and which tent may be quickly assembled, knocked down and easily stored, transported and erected.

The tent comprises a tent shelter material, generally a truncated canopy, and adapted to form a conical tent shelter or teepee-type about an upright, free-standing element, such as a post, and more particularly a tree trunk, such as 4" to 12" or more in diameter, which is or has been delimbed to a selected height, for example, 8 feet to 12 feet or more. The tent shelter material may be of any weatherproof or waterproof material, such as a natural or synthetic material like canvas or nylon or composite layers of synthetic or polymeric sheet material. The tent shelter includes a tent closure or fastening means so that the opposite edges of the tent material can be secured together to form the desired tent structural form about the tree. The closure means may include a zipper-type fastener on the opposing edges, buttons, clasps, Velcro®fasteners or other closures to form a tensioned, closed tent form. The closure means may also be used as the tent entrance, but preferably a separate openable and closable tent entrance on the opposite side of the tent, such as an inverted T-shaped zipper or snap closure is used.

The tent shelter material includes a reinforced top edge web with a plurality of spaced apart holes, like base grommets, therein for the threading through of the holes with a line, like an elastic cord, so that the top of the tent shelter material may be constricted and snugly secured about the diameter of the tree at the desired tent height. Optionally, but desiredly, the line through the top grommet holes is a flexible elastic cord secured at one end to the top web and interwoven through the grommet holes and having a cam cleat at the free end. Preferably, the cam cleat which ensures a tight closing of the top web is securely fastened through or adjacent one of the holes in the top web. The tent material includes a ring means secured to the reinforced web layer and preferably through one of the holes therein. The bottom of the tent material also includes a reinforced edge web with a plurality of spaced apart holes, like base grommets, therein whereby the tent material may be secured in the erected tent position by the use of ground stakes or pins and tent pin cords secured through the holes to the pins. The tent shelter material may include a floor fabric composed of a radial fabric with a centered hole for fitting about the tree of post and may be wrapped about the tree base and closed, such as with a radial positioned zipper.

The tent also includes an adjustable type hoist collar means adapted to be secured peripherally about the diameter of the free-standing tree or post at the desired height level and typically includes a belt and buckle, optionally of stretchable fabric, so that the collar or belt can be snugly and securely fixed about the periphery of the element. The collar or belt also includes fastened thereto a hoist pulley. The hoist pulley may be affixed to the collar or belt, but preferably is secured to a slidable ring so its position can be slidably adjusted about the collar to a desired position on the periphery of the tree. The tent includes a pulley line which is secured either permanently or tied from time to time as required to the ring on the reinforced top edge web and threaded through the pulley hoist so that the tent material can be hoisted about the tree to the tent height. The pulley line should be sufficiently long so that the other end may be secured about the upright tree or post base or to another firm base to retain the tent in its erected form. The tent also includes a plurality of tent pins or ground stakes strong enough and adapted to be pounded and positioned into the ground peripherally about the lower peripheral bottom edge web of the tent material and spaced apart therefrom so that the lower edge of the tent material may be formed into the tent form, such as the teepee shape, and retained by the pins or stakes through ground lines secured to the base grommets of the bottom edge and to the pins or stakes.

The tent kit comprises in combination a portable type bag, such as a flexible travelling bag with handles and/or shoulder straps, which contains as the components of the tent kit: the folded up tent shelter material, including an elastic cord for interweaving in the top web; a plurality of ground stakes; ground stake lanes; a hoist collar or belt with the pulley hoist and a pulley line for use with the hoist pulley.

The tent is erected by selecting a tree and delimbing, if necessary, the tree to the required height. The adjustable or expandable hoist collar is then snugly secured about the tree at a height of 1 or 2 feet higher than the tent height. The pulley line is secured to the belt and pulley of the tent material, and the tent material then hoisted by the user to the tent height with the line vertically flush against the tree, and the free end of the pulley line tied securely to the base of the tree to retain the tent in the upright position. The tent material is then pulled peripherally about the tree, and the closure means used to close the tent material edges. Once the tent shelter material has been hoisted to the desired height, the elastic-type cord moving through the grommets on the top web is used to snugly secure the top web about the tree. The elastic-type cord has a large knot at one end to prevent movement through one grommet or is tied through a grommet, the line is interwoven through the other grommets and the free, loose end passed through the cam cleat so that on pulling, the top web, is closed about the tree and retained in a secure position. It is recognized that other closure means, such as Velcro® tabs, may be used to secure the top edge snugly about the tree. The ground stakes are driven into the ground at a distance from one or two feet the bottom edge web of the tent material, and the ground lines secured to the base grommets on the bottom edge of the tent material and tied tightly to place the tent in the erect form for occupancy.

The invention will be described for the purposes of illustration only in connection with certain embodiments; however, it is recognized that various changes, modifications, additions and improvements may be made in the illustrative embodiments without departing from the spirit and scope of the invention.

BRIEF DESCRIPTION OF THE EMBODIMENTS

Figure 1:
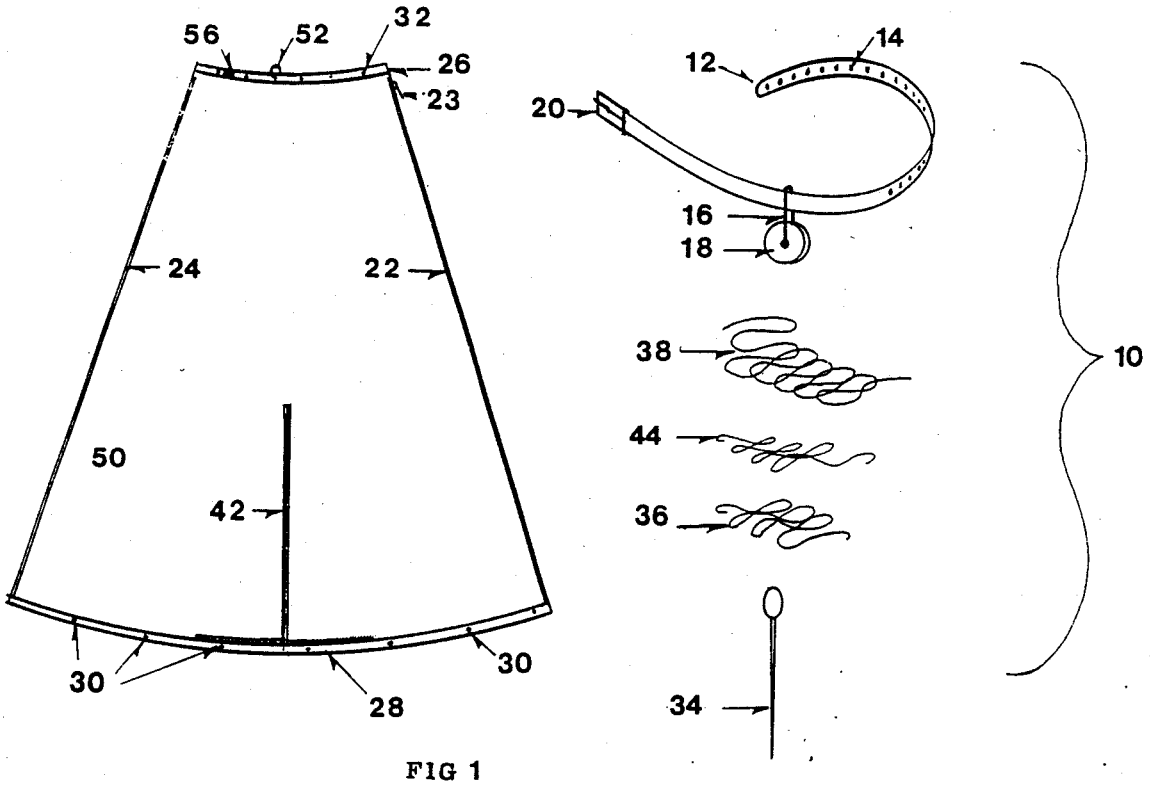
FIG. 1 is a perspective, illustrative view of the components of a tent kit of the invention.

FIG. 1 shows a tent kit 10 adapted to be carried in a package or a knapsack by a tent user. The tent kit 10 includes an adjustable belt 12 with buckle holes 14 therein and a buckle 20 to secure the belt about the tree as shown more particularly in FIG. 2. The belt 12 contains a slidable ring 16 with a hoist pulley 18 secured to the ring. The kit includes a pulley line 38 for use with the hoist pulley 18, an elastic-type line 44 to close the top of the tent, a selected number of ground stakes 34 and ground lines 36 for each stake 34. The kit includes a waterproof tent shelter material 50 adapted to form for example a teepee-type tent and containing mating engageable edge zippers 22 and 24 on and along the entire length of each edge of the tent material and a slidable zipper fastener 23 to open and close the edges. The top edge of the tent material 50 includes a reinforced web layer 26 with a plurality of base metal grommets therein 32 and a ring 52 secured through one of the grommets 32, and a cam cleat 56 secured to the web layer 26 and adapted to receive line 44 and to close the top layer 26 about a tree. The bottom edge of the tent material 50 includes a reinforced bottom layer 28 with base grommets 32 therein.

Figure 2:
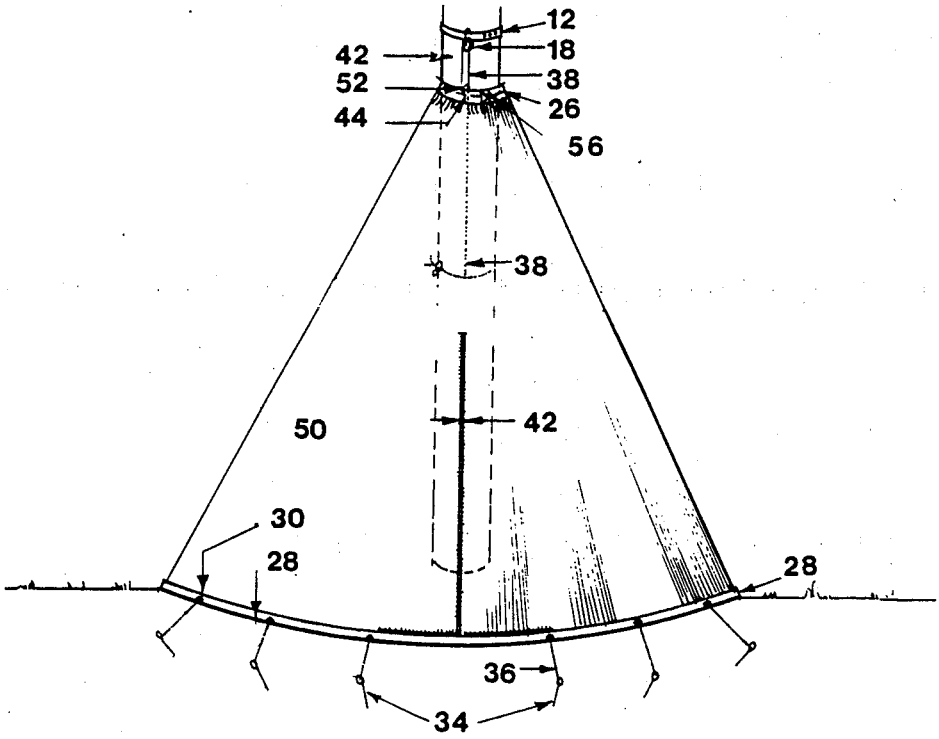
FIG. 2 is a perspective, illustrative, partially sectional view of the erected tent of the invention.

FIG. 2 shows the tent 50 in the tent erected position with the adjustable belt 12 snugly secured about a delimbed tree 42 and with the tent material in a conical form about the tree 42 and hoisted into position by means of the pulley line 38 through the hoist 18 with one end of the line 38 secured to the ring 52 and the line flush with the tree and tent about the tree at the other end. The top edge of the tent material 50 has been secured snugly about the tree diameter by an elastic core 44 interwoven through the grommets 32 and held tightly by the cam cleat 56 to prevent rain from entering the top of the tent. The zipper 23 runs the entire length of the edges to secure together the zipper edges 22 and 24 of the tent material 50. The zippered entrance 58 of the tent material 50 is on the opposite side of the closed tent edges. The zipper 23 has been used to secure the edges together.

The tension enclosure zipper 22, 24 provides for the tensioned formation of the tent, and while the tension zipper can be used as an entrance, it is not recommended due to the need to maintain tension. Therefore, the preferred embodiment as illustrated shows a separate zippered entrance on the opposite side of the tension zipper enclosure. The tent may be disassembled by untying the line 38 and 44 and undoing belt 12 and removing the ground stakes 34 and lines 36 and unzipping the tent material 50.

The tent kit obviates the need to carry a central tent pole. The tent is easily, quickly and simply erected.

What is claimed is:

1. A tent kit for use in the erection of a tent about a free-standing tree or post element, which tent kit comprises in combination:

(a) a tent shelter material to form a tent structure about a free-standing, upright tree or post element and having:

(i) a tent closure means to secure the opposite edges of the tent shelter material together to form the tent structure;

(ii) a top edge web;

(iii) a ring means secured to the top edge web; and (iv) a bottom edge web having a plurality of means to secure the bottom edge web in a tent form erected position (b) top closure means to draw and secure the top edge web of the tent shelter material snugly about the outer periphery of the free-standing tree or post element when the tent is in the erected position;

(c) tent shelter hoist means comprising a belt means adapted to be secured about the periphery of the free-standing tree or post element at a height from the ground above the top edge web and a pulley secured to the belt means and a pulley line for use with the pulley whereby one end of the pulley line may be secured to the ring means, passed through the pulley and employed to hoist the tent shelter material to a desired tent erection height about the free-standing tree or post element and the pulley line then secured to maintain the tent shelter material in the hoisted position and thereafter the top edge web drawn and secured by the top closure means; and (d) a plurality of ground stakes and means to secure the bottom edge of the tent shelter material to the ground stakes to maintain the bottom edge of the hoisted tent shelter material in a tent form structure.

2. The tent kit of claim 1 wherein the tent closure means comprises zipper fastening means extending along and substantially the length of both opposite edges of the tent shelter material.

3. The tent kit of claim 1 wherein the top edge web has a plurality of spaced apart holes therein and the top closure means includes an elastic-type cord for interweaving through said holes and to secure the top edge web snugly about the periphery of the free-standing tree or post element.

4. The tent kit of claim 3 which includes a cam cleat closure means secured to the top edge web and said elastic-type cord adapted to be secured at one end to the top web edge and the other free end passed through the cam cleat means whereby the elastic-type cord can be pulled and the top edge web secured in position.

5. The tent kit of claim 1 wherein the tent shelter material comprises a truncated, conical form material to prepare a conical, teepee-like erected tent.

6. The tent kit of claim 1 wherein the tent shelter material includes a closable tent entrance generally in the middle of the tent shelter material.

7. The tent kit of claim 1 wherein the tent hoist means includes a slidable ring on the belt means and the pulley secured for slidable movement with the slidable ring.

8. The tent kit of claim 1 wherein the belt means includes a belt with a buckle and buckle holes therein for adjusting the belt securely about trees or post elements of varying diameters.

9. The tent kit of claim 1 wherein the bottom edge web of the tent shelter material includes a plurality of spaced apart holes therein and the means to secure the bottom edge web includes a plurality of ground stake lines for securing one end to the bottom edge web and the one to the ground stake in the ground.

10. An erected tent which erected tent comprises:

(a) a free-standing, upright tree or post element; and (b) the erected tent containing the components of the tent kit of claim 1.

11. A tent kit for use in the erection of a tent about a free-standing tree or post element, which tent kit comprises in combination:

(a) a truncated, conical tent shelter to form a conical-type tent about a free-standing, upright tree or post element and having:

(i) a zippered tent closure means extending substantially along the length of each opposite edge of the tent shelter material to secure the edges together and to form a conical-like, erected tent structure;

(ii) a top edge web having a plurality of spaced apart holes therein; iii) a cam cleat means secured to the top edge web to secure an elastic-type line passing through the hoist holes in a secure position so that the top edge web may be snugly secured about the periphery of a free-standing tree or post element in the tent erected position;

(iv) a ring means secured to the top edge web;

(v) a bottom edge web having a plurality of spaced apart holes therein; and (vi) a tent entrance means generally positioned opposite the secured edges of the tent shelter material (b) an elastic-type line having a one and other end, one end adapted to be secured to the top edge width and the other free end after interweaving of the line through the holes of said top edge web adapted to pass through the cam cleat means whereby the top edge web may be snugly secured about the periphery of the free-standing tree or post element;

(c) tent shelter hoist means comprising a belt means adapted to be secured about the periphery of the free-standing tree or post element at a height from the ground and a pulley secured to the belt means and a pulley line for use with the pulley whereby one end of the pulley line may be secured to the ring means, passed through the pulley and employed to hoist the tent shelter material to a desired tent erection height about the free-standing tree or post element and the pulley line then secured to maintain the tent shelter material in the hoisted position;

(d) a plurality of ground stakes for positioning in the ground circumferentially about and spaced apart from the bottom edge web; and (e) a plurality of ground stake lines for attachment between the holes in the bottom edge web and the inserted ground stakes.

12. A method of erecting a tent about a free-standing tree or post element, which method comprises:

(a) selecting an upright, free-standing tree or post element to serve as the central support pole of a tent;

(b) securing an adjustable collar with a pulley hoist to the freestanding element at a defined height;

(c) securing one end of a pulley line to the top edge of a tent shelter material and through the hoist pulley;

(d) pulling the tent material to a defined height employing the pulley line and fixing the other end of the pulley line to the free-standing element;

(e) securing the top edge of the tent material below the adjustable collar snugly about the outer periphery of the free-standing element;

(f) securing the edges of the tent material together to form an enclosed tent structure; and (g) securing the bottom edge of the tent material to the ground in a defined position to form a free-standing tent ready for occupancy and use.

* * * * *

UNITED STATES PATENT AND TRADEMARK OFFICE

CERTIFICATE OF CORRECTION

PATENT NO. : 4,922,942

DATED : *May 8, 1990*

INVENTOR(S) : *Stephen W. Schaefer*

It is certified that error appears in the above-identified patent and that said Letters Patent is hereby corrected as shown below:

On the title page, correct item [76] to read:

*[76]* *Stephen W. Schaefer,* *1639 Homewood Rd., Annapolis, Md. 21401*

Signed and Sealed this

Third Day of September, 1991

*Attest:*

HARRY F. MANBECK, JR.

*Attesting Officer*

*Commissioner of Patents and Trademarks*